United States Patent [19]

Belmonte

[11] Patent Number: 4,808,033

[45] Date of Patent: Feb. 28, 1989

[54] FLEXIBLE PRESSURE COMPENSATING DIVERS WEIGHT BELT

[76] Inventor: Bruce D. J. Belmonte, 3-869 Swan St., Victoria, British Columbia, Canada, V8X 2Z2

[21] Appl. No.: 844,209

[22] Filed: Mar. 26, 1986

[51] Int. Cl.[4] ..... B63C 11/30

[52] U.S. Cl. ..... 405/186; 2/338; 272/119

[58] Field of Search ..... 2/338, 339; 272/119; 405/186

[56] References Cited

U.S. PATENT DOCUMENTS

| | | | |
|---|---|---|---|
| 1,272,519 | 7/1918 | Piper | 2/339 |
| 3,342,036 | 9/1967 | Gruget | 405/186 |
| 3,374,636 | 3/1968 | Mason | 405/186 |
| 3,470,570 | 10/1969 | Christiansen | 405/186 |
| 3,532,339 | 10/1970 | Smith | 272/119 |
| 4,407,497 | 10/1983 | Gracie | 272/119 |
| 4,440,525 | 4/1984 | Perla | 224/224 |
| 4,446,574 | 5/1984 | Kalomeris | 2/338 |

*Primary Examiner*—Dennis L. Taylor
*Attorney, Agent, or Firm*—Townsend & Townsend

[57] ABSTRACT

A flexible pressure compensating weight belt for scuba divers is disclosed. It is comprised of two tubular elastomeric weight compartments adapted to retain lead shot. These compartments are secured to a belt. Upon being worn around a diver's waist, the compartments will stretch and will compensate for varying degrees of water pressure upon the diver, due to its elastomeric properties.

11 Claims, 1 Drawing Sheet

FLEXIBLE PRESSURE COMPENSATING DIVERS WEIGHT BELT

FIELD OF THE INVENTION

This invention relates to weight belts and more particularly to weight belts for scuba divers.

DESCRIPTION OF THE PRIOR ART

In order to overcome the problem associated with the buoyancy of divers, it is necessary for scuba divers to attach a weight belt around the waist. The main type of weight that has been used with belts is cast in lead in various weight ranges. This type of belt weight system is very uncomfortable since the lead weights may dig into the divers flesh causing bruises and pinching in some instances. Another problem associated with weight belts is that as the diver descends below the surface, the pressure on the body causes the body and diving suit to compress and since the weight belt does not compensate, the weight belt around the diver's waist may eventually move around erratically on the diver's waist. This is not only uncomfortable but also can represent a safety hazard. Divers accordingly, at various depths, have to unfasten their belts in order to tighten it. Having to unfasten a weight belt under water is somewhat risky since the diver may loose some weights and risk the possibility of losing the whole belt and thus rising in an uncontrolled ascent.

Prior art weight belts have in the past been unsuccessful in solving the aforementioned problems. For example, U.S. Pat. No. 3,374,636, discloses a weight belt wherein the weight is evenly distributed about the waist of the diver. However, this belt is made of material to provide substantial stiffness to the body of the belt. Accordingly, as the diver descends below the surface and compression becomes pronounced, the weight belt still requires to be adjusted and readjusted, as desired, around the diver's waist.

Another diver's belt is disclosed in U.S. Pat. No. 3,713,299. This weight belt provides an even distribution of weight and allows lead shot to be readily removed from the end of the belt facilitating submerged adjustment of the ballast. Again this weight belt requires continuous adjustment by the divers in order to compensate for water pressure on the body.

Yet another diver's weight belt is described in U.S. Pat. No. 4,440,525. This patent discloses a belt formed from a single piece of material having a plurality of rectangular pockets formed along the belt to hold standard rectangular lead diving weights. Although this belt has been padded in order to make it more comfortable, the continuous weight of the air tank bottle against the belt and the diver's back will quickly render the wearing of this belt uncomfortable. Again, divers will be required to adjust the belt continuously while diving.

Therefore, there is a need for a simple, safe and comfortable weight belt that can be worn with or without a diving suit and be self adjusting as the body and diving suit of the diver compresses due to water pressure.

SUMMARY OF THE INVENTION

It is therefore an object of the present invention to provide a weight belt which will stretch and contract to remain tight and snug, around a diver's waist, at any depth.

Another object of the present invention is to provide a weight belt having sealed elastomeric tubular compartments holding lead shot.

It is still another object of the invention to provide a diver's weight belt in which two rubberized tubes filled with lead shot are supported at the hips of the diver to render it more comfortable.

Another object of the present invention is to provide a diver's weight belt which allows the belt to be free of additional weights between the diver's air tank bottle and his back.

Another object of the present invention is to provide a weight belt having elastomeric compartments and wherein said compartments have opening means to add additional lead shot weight means.

Yet another object of the present invention is to provide a flaccid weight means for use in conjunction with diving belts having a fabric shell substantially filled with lead shot.

According to one aspect, this invention provides a flexible pressure compensating weight belt for scuba divers comprising: flaccid weight means a first and second elastomeric compartment for retaining said flaccid weight means; first strap means having fastening means at one end and said first compartment connected at another end; second strap means having one end adapted to be secured to said fastening means and another end connected to said second compartment, said first and second compartments being connected via connecting means to form a flexible pressure compensating belt, said connecting means allowing a pressurized air tank to remain positioned and comfortably rest against said connecting means between said first and second compartments, whereby when said elastomeric compartments are pre-stretched and said belt worn by a diver in its pre-stretched condition, said belt will compensate for varying degrees of water pressure upon the diver by the contraction of the pre-stretched compartments.

According to a second aspect, this invention provides a flaccid weight means for use with diving belts comprising a sealed bag having an outer shell made of flexible fabric; and a flaccid weight essentially filling said bag.

DRAWINGS

Particular embodiments of the invention will be understood in conjunction with the following drawings.

DESCRIPTION OF THE PREFERRED EMBODIMENTS

Figure 1:
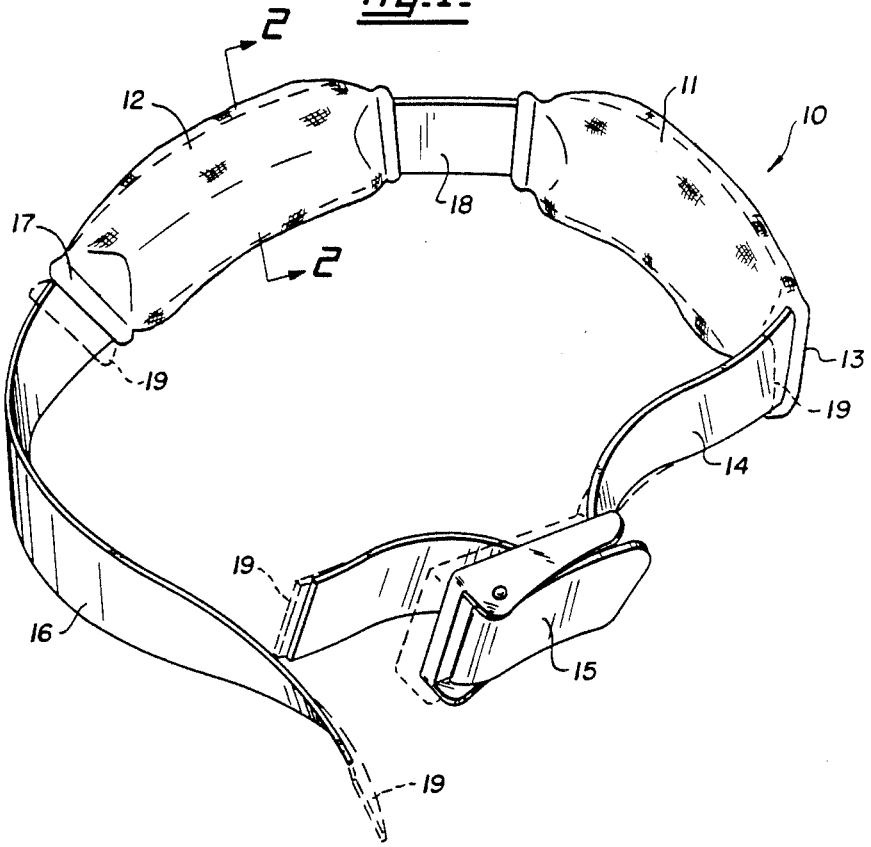
FIG. 1 is an illustrative view of the weight belt according to the present invention.

Referring now to FIG. 1, a perspective view of the weight belt of the invention is shown generally at 10. The belt is comprised of a first and second tube 11 and 12 respectively made of elastomeric material, such as rubber for example, which will allow stretching. Tubes 11 and 12 are filled with lead shot to provide the required weight. Tubes 11 and 12 are then wrapped in a flexible and strong material. First tube 11 is attached at one end 13 to a first strap 14 having a buckle 15 or other suitable fastening means. A second strap 16 adapted to be secured to belt buckle 15 is attached to a first end 17 of tube 12. Tubes 11 and 12 are connected via a third strap 18 which will be located, when worn, at the lower back of the person wearing the belt. Third strap 18 will therefore allow proper positioning of a pressurized air tank container (not shown) between tubes 11 and 12 and strap 18.

Upon wearing the weight belt, a diver will tighten the end of belt 16 into belt buckle 15 thereby prestretching tubes 11 and 12 to a condition shown by broken lines 19. As the diver descends below the surface, the pressure on the body will cause the body to compress and thus the tubes 11 and 12 will contract to retain a tight fit around the diver's body. Tubes 11 and 12 can be sewn onto straps 14, 16 and 18. Belt 10 should preferably be worn so that tubes 11 and 12 rest on the diver's hips thereby offering a greater comfort to the diver and absence of back strain due to the weight belt, and also as indicated earlier permitting proper positioning of an air tank bottle on the diver's back. Such a bottle would rest on belt 18 between tubes 11 and 12.

Figure 2:
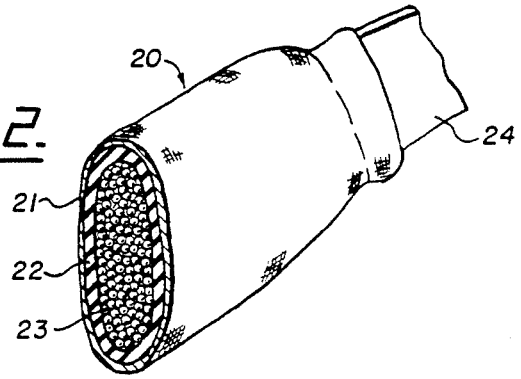
FIG. 2 is a cross-sectional view taken along line 2—2 of FIG. 1.

Referring now to FIG. 2, we have shown a cross-section of a tubular compartment generally shown by reference numeral 20. It is comprised of an outer fabric shell 21 made of a flexible or stretchable fabric such as polyester—lycra—SPANDEX ® material. The weight compartment 22 is made of an elastomeric material such as rubber. It can have a tubular shape to help stretching and conform with a diver's hips. In the present embodiment, the weight compartment 22 is filled with lead shot 23. The lead shot preferably has a 7½ size pellet. The weight compartment 22 becomes sealed once it is sewn to belt 24.

Figure 3:
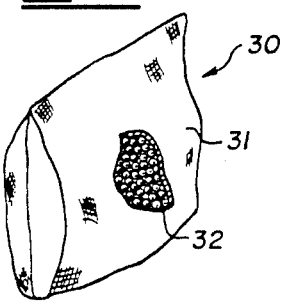
FIG. 3 is a perspective view of flaccid weight means according to another embodiment of the invention.

Referring now to FIG. 3, we have shown a flaccid weight 30 which can be used in conjunction with belt 10 shown in FIG. 1 or other diving weight belt. Flaccid weight 30 is comprised of an outer shell 31 which can be made of a stretchable fabric similar to fabric 21 disclosed in conjunction with FIG. 2. Shell 31 can either be a tubular shell sealed by sewing or other suitable means at its ends or pieces of fabric sealed together at their perimeters to form a bag. This bag can be filled with lead shot 32 which will give it its flaccid properties. Its physical properties make it feasible for divers to use in conjunction with the weight used in the present invention.

For example, it is relatively simple for a diver to insert weight 30 into pockets of buoyancy compensators (not shown) worn by divers to decrease the effect of buoyancy on their bodies.

This becomes important when diving at varying depths. It is a well known principle that the buoyancy effect decreases as depth increases.

For example, a diver at 33 feet below the surface will have half the buoyancy that he would have at the surface. At 66 feet, he will have quarter the buoyancy and at 99 feet one-eighth the buoyancy.

The current practice of divers is to insert rocks into their buoyancy compensators to give themselves more weight underwater at shallower depths.

Accordingly, weight bag 30 would be more practical to use and also allow a diver to compensate for shallow as well as deeper dives by either increasing or decreasing the number of weight bags used in conjunction with weight belt 10 shown in FIG. 1 or other diving weight belts.

Figure 4:
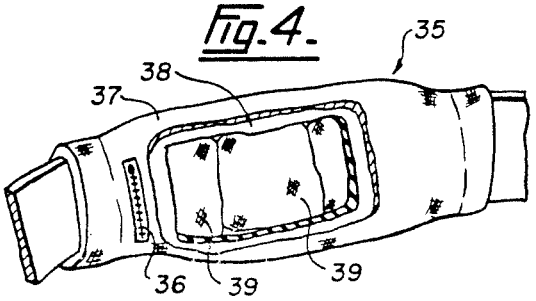
FIG. 4 is a partially sectioned view of another embodiment of the invention.

Referring now to FIG. 4, we have shown at 35 another embodiment of the elastomeric compartment used in the present invention. Elastomeric weight compartment 35 includes opening means 36 on the outer fabric shell 37 and would be used in conjunction with another opening (not shown) on inner shell 38 which is made of elastomeric material. Opening means 36 would permit the insertion and removal of weight bags 39 or other suitable weight means, in order to vary the weight of the weight belt. Opening means 36 can consist of a zipper or other suitable opening and closing devices.

In another embodiment, the belt buckle 15 could be replaced by velcro strips thereby facilitating the fastening of the belt. Although the diver's weight belt disclosed herein has been described with respect to certain materials in construction, it will be obvious to those skilled in the art to make various changes, such as other types of elastomeric materials or other well known fasteners. Such changes are considered to be within the spirit and scope of the invention.

I claim:

1. A flexible pressure compensating weight belt for scuba diver's comprising:

flaccid weight means;

a first and second resilient compartment for retaining said flaccid weight means;

first strap means having fastening means at one end and said first compartment connected at another end;

second strap means having one end adapted to be secured to said fastening means and another end connected to said second compartment;

said first and second compartments being connected via connecting means to form a flexible and elastic pressure compensating belt that is tightened about a diver such that said first and second compartments are stretched and under tension and said connecting means is positioned at the rear of the diver to provide a comfortable resting position for a pressurized air tank between said first and second compartments, whereby as the diver ascends or descends underwater said tensioned belt will stretch and contract due to changing water pressure to maintain a relatively constant tightness about the diver.

2. A weight belt as defined in claim 1 wherein said flaccid weight means comprises a sealed flexible outer shell and a flaccid weight substantially filling said shell.

3. A weight belt as defined in claim 2 wherein said flaccid weight comprises lead shot.

4. A weight belt as defined in claim 3 wherein said first and second elastomeric compartments are positioned at the diver's hips.

5. A weight belt as defined in claim 4 wherein said fastening means comprises a belt buckle.

6. A weight belt as defined in claim 5 wherein said connecting means comprises a third strap.

7. A weight belt as defined in claim 6 wherein said resilient compartments are tubular in shape with one end thereof connected to a first strap and its other end connected to another strap.

8. A weight belt as defined in claim 7 wherein said resilient compartments are comprised of rubber tubes covered by a flexible fabric sewn at each end to one of said straps.

9. A weight belt as defined in claim 8 wherein said flexible fabric is polyester-Lycra-Spandex sewn on each end of said straps.

10. A weight belt as defined in claim 1 wherein said elastomeric compartments includes opening means for adding and removing flaccid weight means.

11. A weight belt as defined in claim 10 wherein said opening means includes a zipper.

* * * * *